United States Patent [19]

Bandy

[11] Patent Number: 5,076,034

[45] Date of Patent: Dec. 31, 1991

[54] VERTICAL EXTERIOR WEATHER SEAL

[75] Inventor: Joseph W. Bandy, Alpharetta, Ga.

[73] Assignee: Kawneer Company, Inc., Norcross, Ga.

[21] Appl. No.: 447,038

[22] Filed: Dec. 7, 1989

Related U.S. Application Data

[63] Continuation-in-part of Ser. No. 271,531, Nov. 15, 1988, abandoned.

[51] Int. Cl.[5] ..... E04H 1/00

[52] U.S. Cl. ..... 52/235; 52/397; 52/468; 52/403

[58] Field of Search ..... 52/235, 397, 398, 403, 52/483, 775, 468, 470, 471, 472

[56] References Cited

U.S. PATENT DOCUMENTS

| | | | |
|---|---|---|---|
| 3,213,584 | 10/1965 | Bush | 52/468 |
| 4,562,680 | 1/1986 | Sukolics | 52/403 |
| 4,650,702 | 3/1987 | Whitmeyer | 52/235 X |
| 4,691,489 | 9/1987 | Shea, Jr. | 52/235 |
| 4,854,095 | 8/1989 | Michlouil | 52/235 |

*Primary Examiner*—Richard E. Chilcot, Jr.
*Attorney, Agent, or Firm*—Jones, Askew & Lunsford

[57] ABSTRACT

A vertical exterior weather seal for use in an adhesively glazed curtain wall system has opposing gasket members formed on either side of a central stem. The rear edge of the stem is received within a channel formed in the front wall of a frame member, and splines formed on the sides of the stem adjacent its rear edge engage the walls of the channel to retain the weather seal in place. A pair of curtain wall panels are butt-glazed to the front wall of the framing member on opposing sides of the weather seal, and the tubular gasket members on either side of the stem bear against the mutually facing lateral edges of the adjacent curtain wall panels to seal the joint between the panels. Because the weather seal requires only that a channel be provided on the front wall of the mullion, the seal is easily adapted to a wide variety of mullion configurations. And since the weather seal is inserted directly into the channel rather than being rotated into place, glazing panels can be installed in any sequence, and reglazing of any individual panel can be accomplished from the interior side of the curtain wall.

18 Claims, 3 Drawing Sheets

VERTICAL EXTERIOR WEATHER SEAL

CROSS REFERENCE TO RELATED APPLICATIONS

The present application is a continuation-in-part of co-pending U.S. patent application Ser. No. 271,531, filed Nov. 15, 1988 now abandoned.

TECHNICAL FIELD

The present invention relates generally to an adhesively glazed curtain wall system, and relates more specifically to a butt-glazed curtain wall system comprising an improved vertical exterior weather seal which permits glazing and weather sealing to be accomplished from the interior side of the curtain wall.

BACKGROUND OF THE INVENTION

In building architecture, a widely used curtain wall construction is the so-called "butt glazing system" wherein vertical mullions do not extend through the curtain wall but rather are adjoined by the wall. The curtain wall panels, typically panes of glass, are adhesively bonded to the building structure in a process known as "structural silicone glazing." This construction permits large expanses of glass unbroken by metal framing elements, which can present an aesthetically desirable appearance.

One of the biggest problems associated with this type of construction is the glazing and weatherproofing of such a structure. Conventional glazing and weather stripping techniques require that the final bead of silicone weatherproofing between adjacent panes be applied from outside the building, which can necessitate the erection of exterior scaffolding and substantially increase labor costs. Additionally, the quality of the weatherproofing joint is largely dependent upon the craftsmanship of the worker applying the sealant. Accordingly, it is highly desirable to provide a system for structural silicone glazing which permits the glazing and weatherproofing to be accomplished entirely from the interior side of the curtain wall, and which provides an attractive and efficient weatherproofing seal without the requirement for highly trained labor.

Previous efforts have been made to provide such a system, one such effort being disclosed in U.S. Pat. No. 4,562,680. The system of that patent requires a specially configured frame member with a chevron-shaped front wall forming an angle of at least 135°. A semicircular channel open along its forward portion is formed at the apex of the angled front wall. A special elongated mullion insert has a gasket formed along a front edge. The rear edge of the mullion insert has a T-shaped connector portion formed thereon. The T-shaped connector portion is wider than the opening in the front of the semicircular channel, such that the connector can be inserted into the channel only by introducing it at an angle and rotating the mullion insert into place. When so installed, the mullion insert is held within the semicircular channel by the width of the T-shaped connector portion being wider than the opening in the front of the channel. To install a curtain wall according to this system, a glazing panel is positioned against the end mullion and the adjacent interior mullion from inside the building. A mullion insert is then installed in the semicircular channel of the chevron-shaped front mullion wall and pivoted so that the gasket portion abuts the edge of the first panel. A second panel is then positioned against the opposite side of the mullion insert and against the next adjacent mullion. The glazing procedure is then repeated progressively.

While the system of the aforementioned U.S. Pat. No. 4,562,680 provides certain advantages over the prior art, it suffers certain drawbacks. First, because the mullion insert must be rotated into position, the glazing panels must be installed progressively, that is, the panels must be set in a particular sequence. This requirement of setting panels progressively not only makes original installation less convenient but also presents difficulties in reglazing, should it later become necessary to replace a panel. Also, because of the requirement that the mullion insert be rotated into place, this system will work only with mullions having a front face of a particular configuration, thereby rendering it impractical for adaptation to other mullion configurations. The mullion insert can be difficult to pivotably install in the semicircular channel. Finally, the resulting construction provides only a single gasket between the panels such that a failure of the single gasket to seal may permit air and water to enter the curtain wall.

A different approach is disclosed in U.S. Pat. No. 4,650,702, wherein each pane of glass of the curtain wall system has a prebonded structural interface adhered along its edges. The structural interface is clipped onto the face of the mullion during installation to fasten the pane to the mullion. The system further comprises a non-structural weather seal between adjacent panels which is installed from the interior side of the curtain wall and which is captured by the structural interface when the panel is clipped onto the mullion.

The aforementioned U.S. Pat. No. 4,650,702 affords certain improvements over the prior art but presents certain limitations. The mechanical interlocking between the structural interface and the face of the mullion requires a mullion configuration which is rather complex. Accordingly, this weather sealing system is not easily adapted to mullions of other configurations. Also, the installation of this system is very labor intensive and requires workers of skilled craftsmanship. This system also requires the panels to be set progressively, and the necessity that the panels be installed in a particular sequence can render it difficult to reglaze a panel from the interior of the curtain wall.

Thus, there is a need to provide a system for butt-glazing curtain wall panels wherein glazing and weatherproofing can be accomplished from the interior side of the curtain wall.

There is a further need to provide a system for butt-glazing curtain wall panels which allows the panels to be installed in any sequence and which permits convenient reglazing of any panel.

There is also a need to provide a system for butt-glazing curtain wall panels which is easily adapted to a wide variety of mullion configurations.

SUMMARY OF THE INVENTION

As will be seen, the present invention overcomes these and other disadvantages associated with prior art butt-glazing systems for curtain wall construction. Stated generally, the present invention comprises a vertical exterior weather seal for sealing the joint between butt-glazed curtain wall panels which permits glazing and weatherproofing to be accomplished from the interior side of the curtain wall. The weather seal construction permits the curtain wall panels to be glazed in any sequence, and any individual panel can be conveniently reglazed from the interior side of the curtain wall. The weather seal is not limited to use with only a structural mullion having a particular cross-section configuration, but rather is easily adapted to a wide variety of mullion configurations.

Stated somewhat more particularly, the present invention in one aspect comprises a vertical exterior weather seal for sealing the joints between adjacent butt-glazed curtain wall panels. The seal comprises an elongated stem member having forward and rear edges. A channel is formed in the front face of the frame member and has a minor axis which is generally perpendicular to the plane defined by the interior surfaces of the panels. The rear edge of the stem is received within a channel formed in the front face of the elongated structural mullion, and a retaining means responsive to insertion of the rear edge of the stem into the channel in a direction coincident to the minor axis of the channel retains the rear edge of the stem within the channel. Gasket members disposed along the stem portion of the weather seal engage the lateral edges of adjacent curtain wall panels to seal the joint between the panels.

In the disclosed embodiment, the weather seal of the present invention comprises an elongated stem having forward and rear edges. A plurality of engaging splines project laterally from the stem along a portion adjacent the rear edge. A pair of primary tubular compression seals is formed on opposing sides of the stem adjacent its forward edge, and a pair of secondary tubular compression seals is formed on opposing sides of the stem at a location spaced rearwardly from the primary compression seals. A locater extends transversely from the stem at a point forward of the engaging splines and rearward of the secondary compression seals to control the depth to which the stem is introduced into the channel.

In the disclosed embodiment, the weather seal is used in conjunction with an elongated frame member having a channel formed in its front face. The rear edge of the stem is received into the channel, and the engaging splines engage the channel walls to retain the stem in place. Advantageously, corrugations may be formed on the channel walls to promote engagement between the splines and the walls of the channel. The stem is inserted into the channel until the locater engages the front wall of the frame member. A curtain wall panel is then butt-glazed on either side of the weather seal, and the primary and secondary tubular compression seals engage the adjacent lateral edges of the curtain wall panels to seal the joint.

All of the installation procedures can be performed from the interior side of the curtain wall. Further, since the weather seal is inserted directly into its channel, rather than being rotated into place, the panels may be installed in any sequence, and reglazing of a single panel can be achieved from the interior side of the curtain wall. And since the only structure required to mount the weather seal to a frame member is a simple channel on the front face of the frame member, this glazing and weatherproofing system is easily adapted to a wide range of mullion configurations.

Thus, it is an object of the present invention to provide an improved weather seal for butt-glazed curtain wall constructions.

It is a further object of the present invention to provide a system for butt-glazing curtain wall panels wherein glazing and weatherproofing can be accomplished from the interior side of the curtain wall.

It is yet another object of the present invention to provide a system for butt-glazing curtain wall panels which allows the panels to be installed in any sequence and which permits convenient reglazing of any individual panel.

It is another object of the present invention to provide a weather seal for butt-glazed curtain wall panels which is easily adapted to a wide variety of mullion configurations.

Other objects, features, and advantages of the present invention will become apparent upon reading the following specification when taken in conjunction with the drawings and the appended claims.

DETAILED DESCRIPTION OF THE DISCLOSED EMBODIMENT

Figure 1:
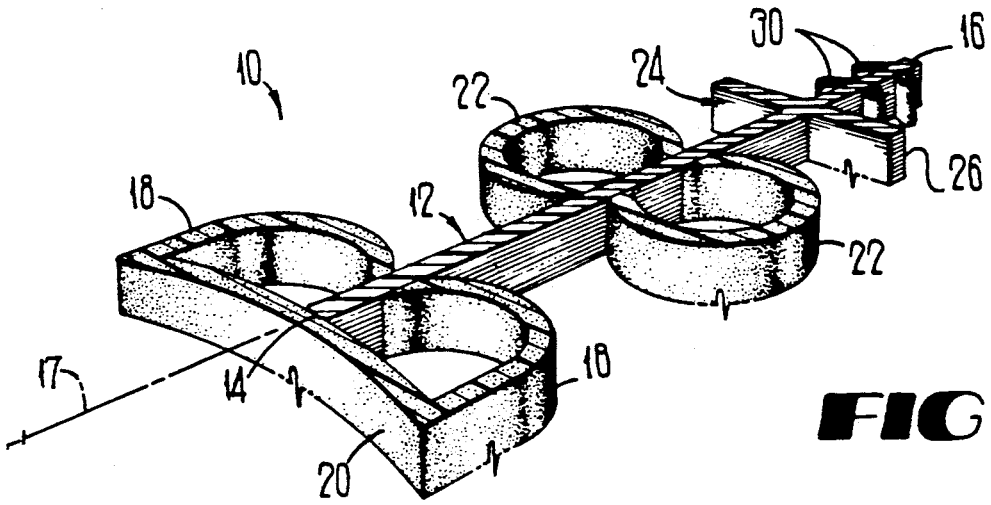
FIG. 1 is a perspective view of a vertical exterior weather seal according to the present invention.

Referring now in more detail to the drawings, in which like numerals indicate like elements throughout the several views, FIG. 1 shows a vertical exterior weather seal 10 according to the present invention. The weather seal 10 is an elongated extrusion of indeterminate length and comprises a stem 12. The stem 12 includes a forward edge 14 and a rear edge 16. Disposed on opposing sides of the stem 12 adjacent its front edge 14 are a pair of primary tubular gasket members or compression seals 18. In the disclosed embodiment, the primary compression seals 18 share a curvilinear exterior gasket wall 20, which provides an aesthetically pleasing exterior appearance and eliminates seams or grooves which can collect dirt and debris.

Spaced rearwardly on the stem 12 from the opposing pair of primary compression seals 18 are an opposing pair of secondary tubular gasket members or compression seals 22. Rearward on the stem 12 from the secondary compression seals 22 and spaced forwardly from the rear edge 16 of the stem is a locater 24. The locater has a rear face 26 which is substantially planar and is normal to the axis of the stem.

On the portion of the stem 12 rearward of the locater 24 and proximate to the rear edge 16 of the stem are a plurality of engaging splines 30. In the disclosed embodiment, the engaging splines 30 are angled away from the rear edge 16 of the stem 12, to the advantage hereinbelow described.

In the disclosed embodiment, the stem 12 and locater 24 of the weather seal 10 are constructed of a rigid polyvinyl chloride (PVC) material. The tubular compression seals 18, 22 and splines 30 are constructed of a flexible PVC material. The rigid and flexible PVC components are advantageously coextruded to form a unitary structure, though other methods and materials for forming the weather seal may be employed.

Figure 2:
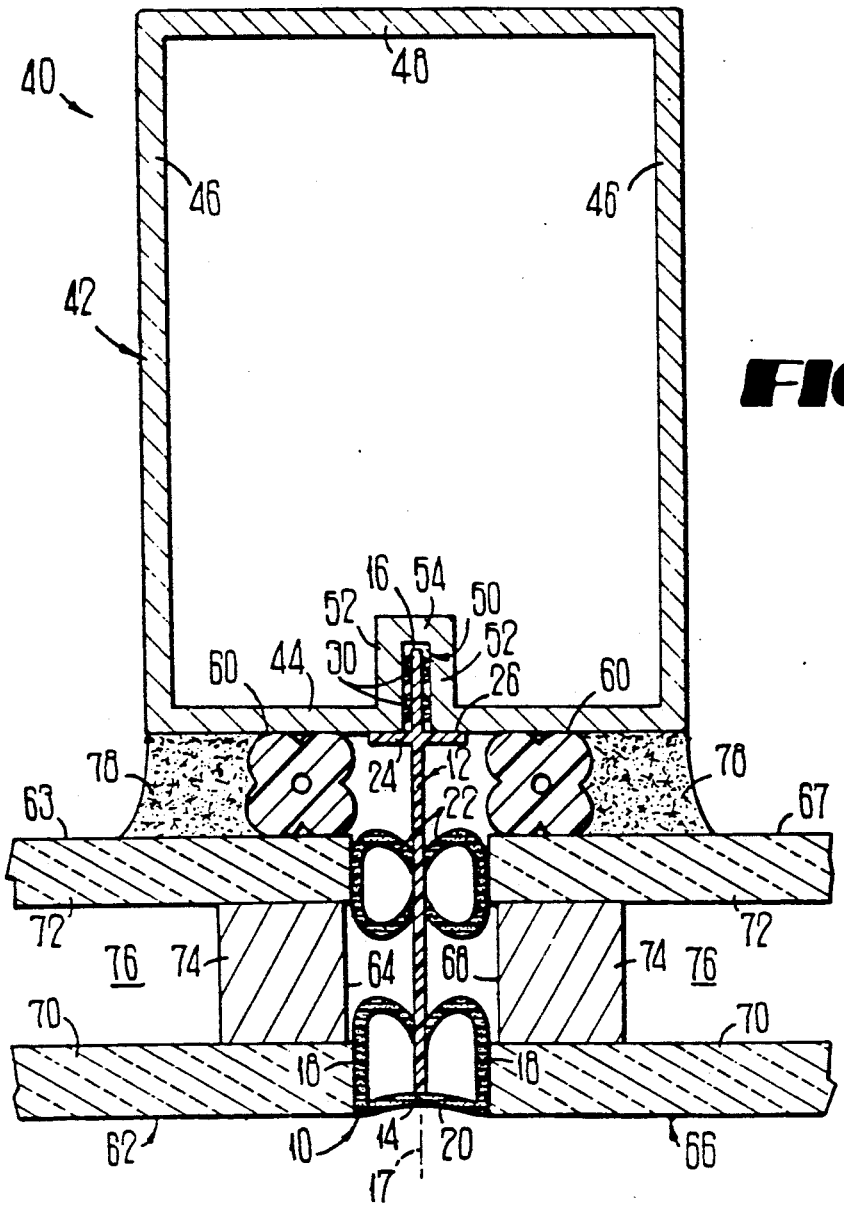
FIG. 2 is a top plan view of a butt-glazed curtain wall construction according to the present invention, including the vertical exterior weather seal of FIG. 1.

FIG. 2 discloses a curtain wall construction 40 comprising the weather seal 10 installed on a structural frame member or mullion 42. The mullion 42 includes a front wall 44, a pair of side walls 46, and a back wall 48. The frame member 42 is an elongated aluminum extrusion of indeterminate length. A channel 50 is formed in the front face 44 of the frame member 42 in the direction of elongation of the frame member 42. The channel 50 is defined by side channel walls 52 and a back channel wall 54. The channel has a minor axis 56 which is disposed generally perpendicular to the front wall 44 of the frame member.

The rear edge 16 of the stem 12 of the weather seal 10 is received within the channel 50 in the front wall 44 of the frame member 42. The engaging splines 30 adjacent the rear edge 16 of the stem 12 engage the side walls 52 of the channel 50 to retain the weather seal in place. The rear planar face 26 of the locater 24 bears against the front wall 44 of the frame member 42.

Disposed against the front wall 44 of the frame member 42 along either side of the weather seal 10 and substantially parallel thereto are a pair of elongated silicone spacers 60. A first glazing panel 62 is butt-glazed with its inner surface 63 abutting one of the silicone spacers 60 and its lateral edge 64 bearing against the weather seal 10. A second glazing panel 66 is butt-glazed opposite the first glazing panel 62 with the inner surface 67 of the second panel abutting the other silicone spacer 60 and the lateral edge 68 of the second panel bearing against the opposite side of the weather seal 10. The curtain wall panels 62, 66 of the disclosed embodiment are double glazed window panes comprising inner and outer panes 70, 72 held in mutually spaced apart relation by a spacer 74 and defining an air space 76 therebetween. With the first and second curtain wall panels 62, 66 thus butt-glazed against the front wall 44 of the mullion 42, the primary and secondary compression seals 18, 22 bear against the lateral edges 64, 68 of the curtain wall panels to seal the joint between the panels against air, moisture, and debris. It will be appreciated that the inner surfaces 63, 67 of the glazing panels 62, 66 define a plane which is substantially parallel to the front wall 44 of the frame member 42 and, consequently, which is substantially perpendicular to the minor axis 56 of the channel 50.

Beads 78 of structural silicone adhesively bond the glazing panels 62, 66 to the front face 44 of the frame member 42. While the curtain wall panels 62, 66 of the disclosed embodiment are panels of double-pane insulated glass, it will be appreciated that the weather seal 10 of the present invention is equally suited for use with other types of curtain wall panels.

Figure 3:
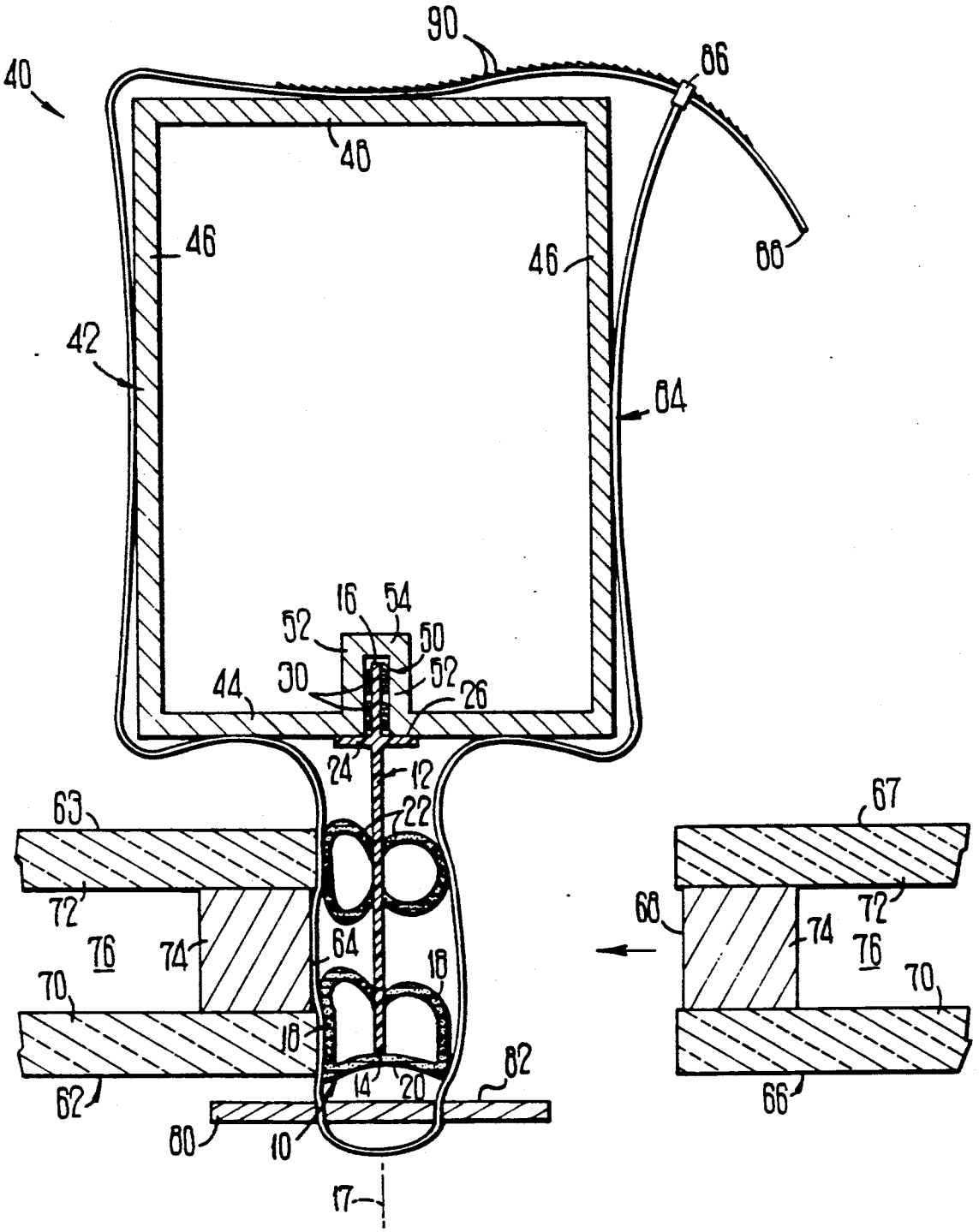
FIG. 3 is a top plan view of the butt-glazed curtain wall construction of FIG. 2 partially assembled.
Figure 4:
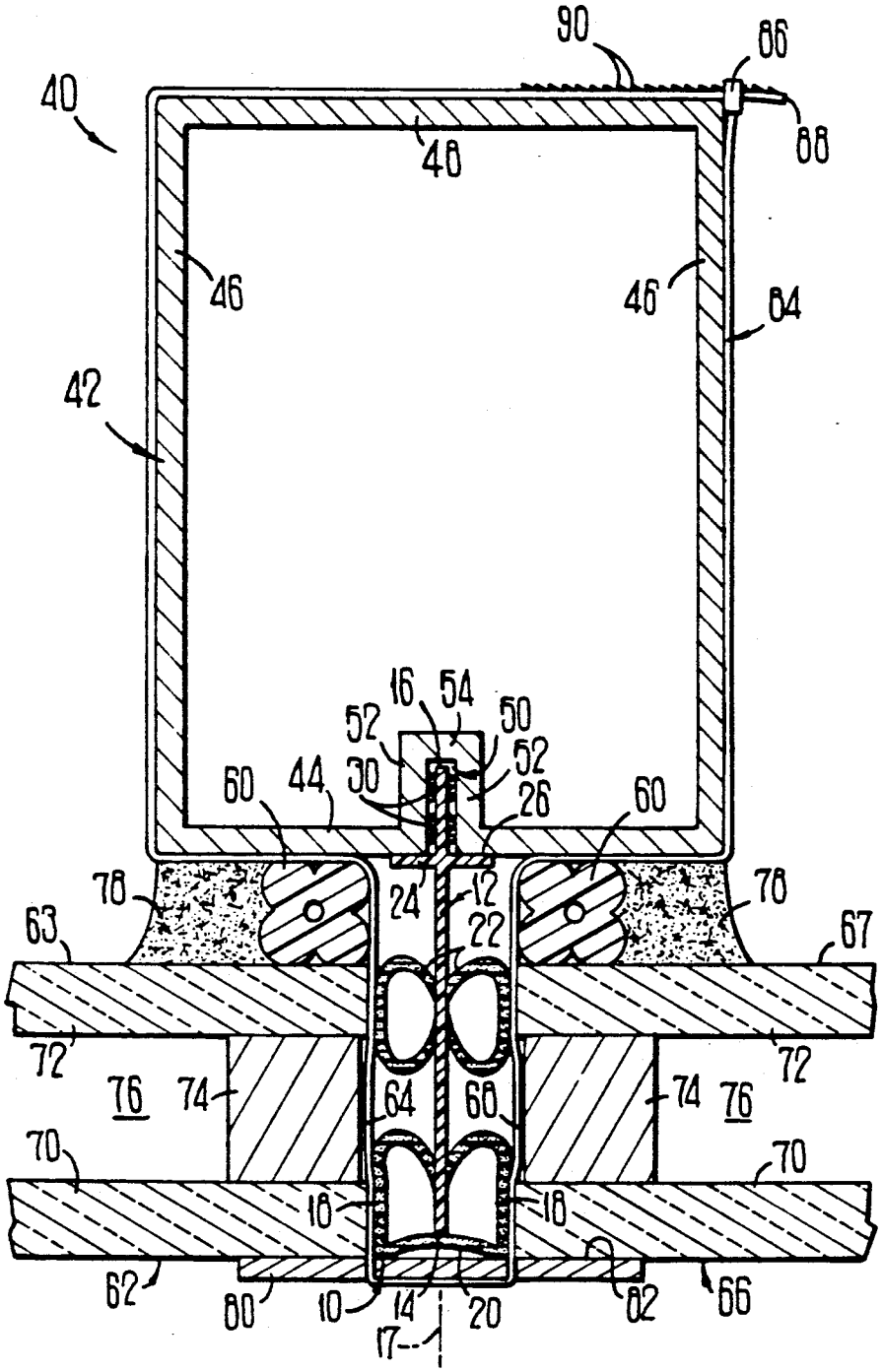
FIG. 4 is a top plan view showing a later stage of assembly of the butt-glazed curtain wall of FIG. 2.

FIGS. 3 and 4 depict the glazing procedure for erecting the curtain wall construction 40 previously described. Referring first to FIG. 3, one glazing panel 62 is positioned adjacent the front face 44 of the frame member 42. The inner surface 63 of the glazing panel 62 is in mutually facing, spaced-apart relation to the front face 44 of the frame member 42, and the lateral edge 64 of the panel extends slightly less than half way across the front face of the frame member.

The weather seal 10 is then installed on the front face 44 of the frame member 42 by inserting the rear edge 16 of the stem 12 into the channel 50 along the direction of the minor axis 56 of the channel. Thus, the stem 12 is inserted into the channel 50 in a direction perpendicular to the plane defined by the inner surfaces 63, 67 of the glazing panels 62, 66 and also perpendicular to the front wall 44 of the frame member 42. The stem 12 is inserted into the channel 50 until the rear face 26 of the locater 24 bears against the front wall 44 of the frame member 42. Thus, the locater 24 limits the depth to which the rear edge 16 of the stem 12 can be inserted into the channel 50. The locator 24 also serves to control the extent by which the seal 10 extends forwardly from the front wall 44 of the frame member 42. As the rear edge 16 of the stem 12 is inserted into the channel in the direction along the axis 56 of the channel 50, the splines 30 engage the side walls 52 of the channel. The flexible PVC material comprising the splines 30 grips the side walls 52 of the channel to retain the weather seal 10 in place. The angular orientation of the splines 30 in the direction away from the rear edge 16 of the weather seal facilitates insertion of the seal into the channel 50. However, any outward force on the weather seal 10 will increase the pressure of the splines 30 against the channel walls 52, causing the splines to "dig in" and resist disengagement of the stem from the channel 50.

With the weather seal 10 thus installed on the front wall 44 of the frame member 42, a temporary retainer clip 80 is positioned to hold the glazing panel 62 temporarily in place. The retainer clip 80 is a substantially planar member, the back edge 82 of which is superimposed against the front gasket wall 20 of the weather seal 10. The retainer clip 80 is held in place against the weather seal by a tie strap 84, which is threaded around the frame member 42, between the weather seal 10 and the lateral edge 64 of the glazing panel 62, and through apertures in the retainer clip. The tie strap 84 has an eyelet 86 formed on one end thereof. The other end 88 of the tie strap is passed through the eyelet 86 and has a plurality of serrations 90 formed thereon. The serrations 90 permit the end 88 of the tie strap 84 to be drawn through the eyelet 86, but they do not permit the end 88 to be drawn back through the eyelet. This fastening arrangement makes it possible to tighten the tie strap easily, and the tie strap, once tightened, will not come loose. As shown in FIG. 3, the retainer clip 80 is installed only loosely while the initial stages of the glazing procedure are in progress.

With the retainer clip 80 thus loosely positioned, the lateral edge 68 of the second glazing panel 66 is then fed between the back surface 82 of the retainer clip 80 and the front face 44 of the frame member 42 on the side of the weather seal 10 opposite the first glazing panel 62. The pair of silicone spacers 60 are then positioned between the rear faces of the frame members 62, 66 and the front face 44 of the frame member 42, as shown in FIG. 4. With the spacers thus positioned, the tie strap 84 is tightened from the interior side of the curtain wall by pulling the end 88 of the tie strap through the eyelet 86.

Referring to FIG. 4, with the structure temporarily held in place by the retainer clip 80 and tie strap 84, beads 78 of structural silicone are applied between the front wall 44 of the frame member 42 and the inner surfaces 63, 67 of the glazing panels 62, 66 to bond the glazing panels to the front wall of the frame member. The retainer clip 80 and tie strap 84 are left in place for approximately a week to ten days to hold the glazing panels 62, 66 in place while the structural silicone beads 78 set. When the bond has sufficiently cured, the tie strap 84 is cut at a point on the interior side of the glazing panels 62, 66, and the tie strap is pulled through on the interior side of the glazing panels. When the tie strap 84 is removed, the retainer clip 80 on the opposite side of the glazing panels will simply fall to the ground. Upon removal of the retainer clip 80 and tie strap 84, installation is complete, and the resulting structure is as depicted in FIG. 2.

With the tie strap and retainer clip removed, the glazing panels are held in place entirely by the structural silicone bond. The weather seal 10 is non-structural, in the sense that it does not assist in retaining the glazing panels 62, 66 in place, nor does it support any portion of the weight of the glazing panels. However, the primary and secondary compression seals 18, 22 independently intimately engage the mutually facing lateral edges 64, 68 of the glazing panels 62, 66 to seal the joint between the panels against penetration by air, moisture, or debris. Further, the primary and secondary compression seals are redundant, such that a gasket failure by either the primary or the secondary seal will not compromise the integrity of the weather seal.

While planar gasket members can be used, the tubular gasket members 18, 22 of the present invention afford the additional advantage that, as the tubular compression seals are compressed by contact with the lateral edges 64, 68 of the glazing panels 62, 66, the space between the primary and secondary compression seals 18, 22 becomes a pressurized air pocket for improved insulative performance.

It will be appreciated by those skilled in the art that the entire butt-glazing operation can be accomplished from the interior side of the curtain wall. Also, the direct insertion of the stem of the weather seal into the channel formed on the face of the frame member affords considerable ease in installation. Since the weather seal is inserted directly into its channel in a direction perpendicular to the plane defined by the inner surfaces of the glazing panels, rather than being inserted into the channel at an angle to the plane and subsequently rotated into position, the glazing panels need not be installed progressively but can be installed in any sequence. Further, any individual panel can be reglazed entirely from the interior side of the curtain wall and without the necessity of applying a weather seal from the exterior of the building. And since the weather seal of the present invention requires only a simple channel in order to engage the frame member, the weather seal is not limited to a particular mullion configuration, but instead can be easily adapted to a wide variety of cross-sectional mullion configurations.

It will be understood that references to "butt-glazing" or to curtain wall panels "abutting " the front wall of a mullion are intended to encompass installations wherein the curtain wall panels are held in spaced-apart relation from the face of the mullion by an insulating spacer or the like, and are not to be construed as requiring direct contact between the curtain wall panel and the mullion face.

The preferred embodiment has been disclosed with respect to a weather seal 10 in which the rigid and flexible components are comprised of rigid and flexible PVC, respectively, coextruded to form a unitary structure. However, it will be understood that the stem 12 and locater 24 may be comprised of any rigid thermoplastic, and the compression seals 18, 22 and splines 30 may be comprised of any flexible thermoplastic so long as the rigid and flexible thermoplastics are compatible for coextruding.

While the installation procedure of the disclosed embodiment has been described with respect to a tie strap having a serrated end which is passed through an eyelet, it will be appreciated that other means of temporarily securing the retainer clip in place may be employed.

Finally, it will be understood that the preferred embodiment of the present invention has been disclosed by way of example, and that other modifications may occur to those skilled in the art without departing from the scope and spirit of the appended claims.

What is claimed is:

1. A curtain wall construction comprising:

an elongated structural mullion having a front face;

means defining a channel in said front face of said elongated structural mullion in the direction of elongation of said elongated structural mullion;

a first curtain wall panel having a lateral edge and an inner surface, said inner surface of said first curtain wall panel adjacent said lateral edge adjoining said front face of said elongated structural mullion;

a second curtain wall panel having a lateral edge and an inner surface, said inner surface of said second curtain wall panel adjacent said lateral edge adjoining said front face of said elongated structural mullion, said first and second curtain wall panels being disposed with said lateral edges in mutually facing spaced-apart relation, and said inner surfaces of said first and second curtain wall panels defining a plane; and an elongated weather seal comprising:

an elongated stem having forward and rear edges, said elongated stem being disposed between said lateral edges of said first and second wall panels with said rear edge of said elongated stem received within said channel in said front face of said elongated structural member;

means responsive to insertion of said rear edge of said elongated stem into said channel in a direction perpendicular to said plane defined by said inner surfaces of said first and second curtain wall panels for retaining said rear edge of said elongated stem within said channel;

a pair of gasket members disposed on opposing sides of said elongated stem adjacent said forward edge thereof and engaging said lateral edges of said first and second wall panels so as to form a seal between said lateral edges of said first and second wall panels.

2. The curtain wall construction of claim 1, further comprising a thermally insulative spacer disposed between said inner surface of each of said curtain wall panels and said front face of said structural mullion, whereby said structural mullion is thermally insulated from said curtain wall panels.

3. The curtain wall construction of claim 1, further comprising a bead of adhesive for bonding said inner surface of each of said curtain wall panels to said front face of said structural mullion.

4. The curtain wall construction of claim 1, wherein each of said pair of gasket members comprises a tubular gasket member.

5. The curtain wall construction of claim 4, wherein said pair of tubular gasket members comprises a pair of primary tubular gasket members, and wherein said seal between said lateral edges of said first and second wall panels comprises a primary seal, and further comprising a pair of secondary tubular gasket members disposed on opposing sides of said elongated stem and spaced rearwardly from said pair of primary opposing tubular gasket members, said pair of secondary tubular gasket members engaging said lateral edges of said first and second wall panels to provide a secondary seal between said lateral edges of said first and second wall panels.

6. The curtain wall construction of claim 1, wherein said gasket members are comprised of flexible thermoplastic material, said stem is comprised of rigid thermoplastic material, and said gasket members and said stem are coextruded as a unitary structure.

7. The curtain wall construction of claim 1, wherein said means responsive to insertion of said rear edge of said elongated stem into said channel in a direction perpendicular to said plane defined by said inner surfaces of said first and second curtain wall panels for retaining said rear edge of said elongated stem within said channel comprises a plurality of splines projecting from said stem proximate said rear edge of said stem, whereby when said rear edge of said stem is inserted into said channel said splines engage said means defining said channel to retain said rear edge of said stem within said channel.

8. The curtain wall construction of claim 1, wherein said means responsive to insertion of said rear edge of said elongated stem into said channel in said elongated structural member in a direction normal to said plane defined by said inner surfaces of said first and second wall panels for retaining said rear edge of said elongated stem within said channel comprises:

a plurality of splines formed on one of said elongated stem or said means defining said channel; and a plurality of serrations formed on the other of said elongated stem or said means defining said channel, whereby upon insertion of said rear edge of said elongated stem into said channel, said splines engage said serrations to retain said rear edge of said elongated stem within said channel.

9. The curtain wall construction of claim 1, further comprising a stop member projecting transversely from said stem member at a predetermined location and having a width greater than the width of said channel formed in said face of said elongated structural member, whereby said stem member can be received within said channel member only as far as said stop member.

10. A weather seal for installation onto an elongated structural mullion having a front face with a channel defined therein in the direction of elongation of said elongated structural mullion, and said channel having a minor axis in a direction generally perpendicular to said front face of said structural mullion, said weather seal comprising:

an elongated stem having forward and rear edges;

means responsive to insertion of said rear edge of said elongated stem into said channel in a direction along the minor axis of said channel for retaining said rear edge of said elongated stem within said channel; and a pair of gasket members disposed on opposing sides of said elongated stem adjacent said forward edge thereof.

11. The weather seal of claim 10, wherein said pair of gasket members comprises a pair of tubular gasket members.

12. The weather seal of claim 11, wherein said pair of tubular gasket members comprises a first pair of tubular gasket members, and further comprising a second pair of tubular gasket members disposed on opposing sides of said elongated stem at a location on said stem spaced rearwardly from said first pair of tubular gasket members.

13. The weather seal of claim 10, wherein said means responsive to insertion of said rear edge of said elongated stem into said channel in a direction along the minor axis of said channel for retaining said rear edge of said elongated stem within said channel comprises a plurality of engaging splines projecting from said stem proximate said rear edge thereof.

14. The weather seal of claim 10, further comprising a stop member projecting from said stem transversely to said minor axis thereof at a location on said stem corresponding to the maximum depth of insertion of said stem into said channel.

15. The weather seal of claim 10, wherein said gasket members are comprised of flexible thermoplastic material, said stem is comprised of rigid thermoplastic material, and said tubular gasket members and said stem are coextruded as a unitary structure.

16. A weather seal comprising:

an elongated stem having forward and rear edges;

a plurality of engaging splines projecting from said stem proximate said rear edge thereof for retaining said rear edge of said elongated stem within a channel;

a pair of gasket members disposed on opposing sides of said elongated stem adjacent said forward edge thereof; and a stop member projecting transversely from said stem at a location spaced forward from said rear edge of said stem by a distance corresponding to a desired maximum depth of insertion of said stem into said channel.

17. The weather seal of claim 16, wherein said pair of gasket members comprises a first pair of tubular gasket members, and further comprising a second pair of tubular gasket members disposed on opposing sides of said elongated stem at a location on said stem spaced rearwardly from said first pair of tubular gasket members.

18. The weather seal of claim 16, wherein said gasket members are comprised of flexible thermoplastic material, said stem is comprised of rigid thermoplastic material, and said tubular gasket members and said stem are coextruded as a unitary structure.

* * * * *